US007165975B2

(12) United States Patent
Hasegawa et al.

(10) Patent No.: US 7,165,975 B2
(45) Date of Patent: Jan. 23, 2007

(54) ELECTRICAL CONNECTING APPARATUS

(75) Inventors: Yoshiei Hasegawa, Kanagawa (JP); Masayoshi Hasegawa, Tokyo (JP); Eichi Osato, Tokyo (JP)

(73) Assignee: Kabushiki Kaisha Nihon Micronics, Tokyo (JP)

( * ) Notice: Subject to any disclaimer, the term of this patent is extended or adjusted under 35 U.S.C. 154(b) by 0 days.

(21) Appl. No.: 10/543,254

(22) PCT Filed: Feb. 10, 2003

(86) PCT No.: PCT/JP03/01381

§ 371 (c)(1),
(2), (4) Date: Jul. 22, 2005

(87) PCT Pub. No.: WO2004/070890

PCT Pub. Date: Aug. 19, 2004

(65) Prior Publication Data

US 2006/0128175 A1 Jun. 15, 2006

(51) Int. Cl.
*H01R 12/00* (2006.01)

(52) U.S. Cl. ..... 439/66

(58) Field of Classification Search ..... 439/43, 439/502, 59, 79, 130, 151, 210, 66, 71, 91, 439/591

See application file for complete search history.

(56) References Cited

U.S. PATENT DOCUMENTS

| | | | | |
|---|---|---|---|---|
| 4,326,765 | A * | 4/1982 | Brancaleone | 439/69 |
| 4,851,613 | A * | 7/1989 | Jacques | 174/254 |
| 5,938,451 | A * | 8/1999 | Rathburn | 439/66 |
| 6,084,421 | A | 7/2000 | Swart et al. | 324/755 |
| 6,450,821 | B2 * | 9/2002 | Otsuki et al. | 439/70 |
| 6,776,624 | B2 * | 8/2004 | Suematsu | 439/71 |

FOREIGN PATENT DOCUMENTS

| | | |
|---|---|---|
| EP | 1128479 | 8/2001 |
| JP | 46-12017 | 3/1971 |
| JP | 06-061321 | 3/1994 |
| JP | 11-297444 | 10/1999 |
| JP | 2001-250600 | 9/2001 |

* cited by examiner

*Primary Examiner*—James Harvey
*Assistant Examiner*—Travis Chambers
(74) *Attorney, Agent, or Firm*—Robert J. Rose; Michael Fedrick; Sheldon Mak Rose & Anderson

(57) ABSTRACT

An electrical connecting apparatus is characterized by inserting a first pin having a flange portion into a through hole of an elastic body via a seat, by disposing a second pin in the through hole so as to adjoin in the axial direction of the through hole relative to the first pin, and by bringing the first and second pins into contact in a plane region having a certain angle to the axis of the through hole.

13 Claims, 11 Drawing Sheets

(A)

(B)

ELECTRICAL CONNECTING APPARATUS

CROSS-REFERENCE TO RELATED APPLICATION

This Application claims priority from International Application Number PCT/JP03/001381, titled "Electrical Connecting Apparatus," filed Feb. 10, 2003.

FIELD OF ART

The present invention relates to an electrical connecting apparatus for use in an electric test of a plate-like device under test such as a semiconductor device.

BACKGROUND OF ART

An electric test of a plate-like device under test provided with a plurality of electrodes such as a semiconductor device is generally conducted, using an electric connecting apparatus such as a probe card, a probe unit, a probe block and the like.

As one of such electric connecting apparatus, there is a type provided with a cylindrical elastic body and a first and a second contact pins disposed in a through hole portion of this elastic body (Patent Document 1).

Patent Document 1:

Japanese Patent Appln. Public Disclosure No. 2001-250600

In this conventional apparatus, the first and second pins are disposed to adjoin each other in the axial direction of the through hole portion and come in contact in an inclined plane inclined to the axis of the through hole portion, and the apparatus is further provided with a flange-like base, which is in contact with a face of an elastic plate, at an end portion on the opposite side to the inclined plane.

In this conventional apparatus, when energizing force is exerted in a direction to make the first and second pins approach each other, both pins displace along the inclined plane with which they are in contact to compress and deform the elastic body in the axial direction of the through hole, deforming the through hole in a direction to expand, and when the energizing force is no longer exerted on the first and second pins, the pins are restored to their initial state by the elastic force of the elastic body.

In the above-mentioned conventional electrical connecting apparatus, however, though the elastic body is elastically deformed in the axial direction when the energizing force is exerted on the first and second pins, a part which compresses and deforms the elastic body in its axial direction is merely the flange-like base. Therefore, the force compressing and deforming the elastic body in its axial direction is greatly counteracted by the force expanding the through hole, so that the amount of compression and deformation of the elastic body due to the energizing force is remarkably small. Also, the force to compress and deform the elastic body in its axial direction falls short.

Also, in the foregoing conventional electrical connecting apparatus, when the energizing force is no longer exerted on the first and second pins, the force which has compressed and deformed the elastic body in the direction to expand the through hole acts as frictional resistance force to the first pin which tends to return to the axial direction of the through hole. For this reason, restoring force acting on the first pin due to the force which has compressed and deformed the elastic body in the axial direction of the through hole is greatly counteracted by the restoring force acting on the first pin due to the force which has expanded the through hole.

As a result, in the conventional electrical connecting apparatus, when the energizing force no longer acts on the first and second pins, the restoring force for returning the first and second pins to their initial states, more particularly, the force for displacing the first pin in a direction to be apart from the second pin falls short.

SUMMARY OF THE INVENTION

The electrical connecting apparatus according to the present invention comprises: a plate-like elastic body with a plurality of first through holes penetrating the elastic body in its thickness direction; a plurality of elastically deformable seats having second through holes individually corresponding to said first through holes and arranged in the elastic body, each second through hole penetrating said seat in its thickness direction and being communicated to the corresponding first through holes; a plurality of first pins, each provided with a first portion received in the first and second through holes, a second portion projected from the second through hole, and a flange portion which is capable of contacting with the seat; and a plurality of second pins received in the first through holes so as to adjoin in the axial direction of the first through holes relative to the first pins. At least one of the first and second pins further include on the other side a plane region having an angle to the axis of the first through holes, the other of the first and second pins include on the other side positions capable of contacting the plane region.

The electrical connecting apparatus is used, for example, with the elastic body assembled into a wiring base plate such that the first through holes are individually opened into a plurality of connection lands. At the time of an electrical test, an electrical connecting apparatus and a plate-like device under test such as a semiconductor device are relatively pressed such that an electrode of the device under test is brought into contact with the end portion on the first portion side of the first pin.

By this, the first pin presses the second pin, so that the first and second pins are relatively displaced. As a result, while elastically deforming the corresponding seat, the first pin is displaced at least in the axial direction of the first through hole to compress and deform the elastic body by the flange portion via the seat in the thickness direction. On the other hand, the second pin compresses and deforms mainly the first through hole in a direction to expand the first through hole, because the plane region has an angle to the axis of the first through hole.

At the time of the above-mentioned deformation by compression, since force to compress the elastic body in its thickness direction acts on the elastic body through the seat, the force is greater than when the elastic body is directly deformed by the flange portion and a case where the first through hole is expanded by the first pin.

When pressure against the first and second pins is released, the first and second pins are restored to their initial states by the elastic force (restoring force) of the elastic body. At this time, the first pin is guided by the seat mainly in the axial direction of the first through hole, and the force to make the first pin return in the axial direction of the first through hole acts on the flange portion through the seat. Furthermore, the frictional resistance between the first pin and the elastic body when the first pin returns in the axial direction of the first through hole is remarkably small, because the force for the first pin to compress and deform the elastic body so as to expand the first through hole is small, compared with the conventional apparatus.

As a result, according to the present invention, the compressive force to compress and deform the elastic body and the restoring force to return the first pin in the axial direction of the first through hole become greater than the conventional apparatus, and the first and second pins surely return to their initial states.

The electrical connecting apparatus can further comprise a wiring base plate provided with a plurality of connection lands individually corresponding to the first through holes, wherein each first through hole is opened individually in the connection land. By doing so, the elastic body can be assembled into the wiring base plate.

The second pin may have the end portion opposite to the first pin formed as a spherical plane and may be brought into contact with the connection land at a part of the spherical plane. By doing so, when the first and second pins are relatively pressed, since the second pin is pressed against the connection land, and since the first and second pins are in contact in the plane region intersecting the axis of the first through hole, the second pin is easily inclined along the spherical plane, so that the first pin tends to be easily displaced in the axial direction of the first through hole.

Both first and second pins may be provided with the plane region. By doing so, when the first and second pins are relatively pressed, the contact area of the first and second pins is increased, so that the electrical contact resistance of the first and second pins is decreased. Also, when the first and second pins are relatively pressed and when the pressure is released, the first pin is surely displaced in the axial direction of the first through hole.

The plane region of either one of the first and second pins may have a convex cross sectional shape, and the other plane region may have a concave cross sectional shape into which the one plane region is fitted so as to relatively displace. By doing so, the first and second pins is prevented from relatively displacing in the cross-sectional direction.

The plural seats may be integrally formed with a seat-like member having the second through holes and laid on the elastic body. This facilitates positioning of the seats and the elastic body, and the first pin, being guided to the second through hole, is surely displaced mainly in the axial direction of the first through hole.

In order to make seat-like regions around adjoining second through holes as the seats, the seat-like member can be further provided with a plurality of slits for dividing so that those seat-like regions continue partially. By doing so, when the first and second pins are relatively pressed and when the pressing is released, each seat-like region is independently surely deformed, so that the first pin is surely moved in the axial direction of the first through holes.

The electrical connecting apparatus can further comprise a presser plate laid on the seat, wherein the presser plate can be provided with a plurality of holes individually receiving the second portions of the first pins with their tip portions projected, and a plurality of recesses communicated to the holes and individually receiving the flange portions. This prevents falling of the first pins from the first and second through holes.

The first pin can be further provided with one or more pyramidal projections projecting further from the second portion. By doing so, the electrode of the device under test and the first pin are surely brought into contact.

The elastic body can be further provided with a recess around the first through hole and opening on the side of the seat. Thereby, when the first and second pins are relatively pressed, the second pin is easily inclined, so that it becomes easy for the first pin to be displaced in the axial direction of the first through hole.

The second pin may have not only the plane region but also an L-shaped stage portion in the lower part of the plane region, and the elastic body may further have a presser portion projected within the first through hole and for pressing the second pin at the stage portion, and the first pin and the stage portion may have a space where the first pin escapes when the first and second pins are relatively pressed formed inside the first through hole and above the presser portion. This enables to increase an over drive amount to be acted on the device under test and raise a contact pressure of the first and second pins as well as the contact pressure of the second pin and the connection land, so that the electrical contact resistance at those contact positions can be decreased.

BRIEF DESCRIPTION OF THE DRAWINGS

FIGS. 9A and 9B are vertical sections showing the neighborhood of the first and second pins for explaining the motion of the electrical connecting apparatus shown in FIG. 1, in which FIG. 9A shows a state when an over drive is not acted and FIG. 9B shows a state when an over drive is acted.

FIGS. 10A and 10B are views showing part of another embodiment of the electrical connecting apparatus, in which FIG. 10A is a plan view and FIG. 10B a vertical section.

FIGS. 11A and 11B are views showing part of the other embodiment of the electrical connecting apparatus, in which FIG. 11A shows a state when an over drive is not acted and FIG. 11B a state when an over drive is acted.

DETAILED DESCRIPTION

Figure 1:
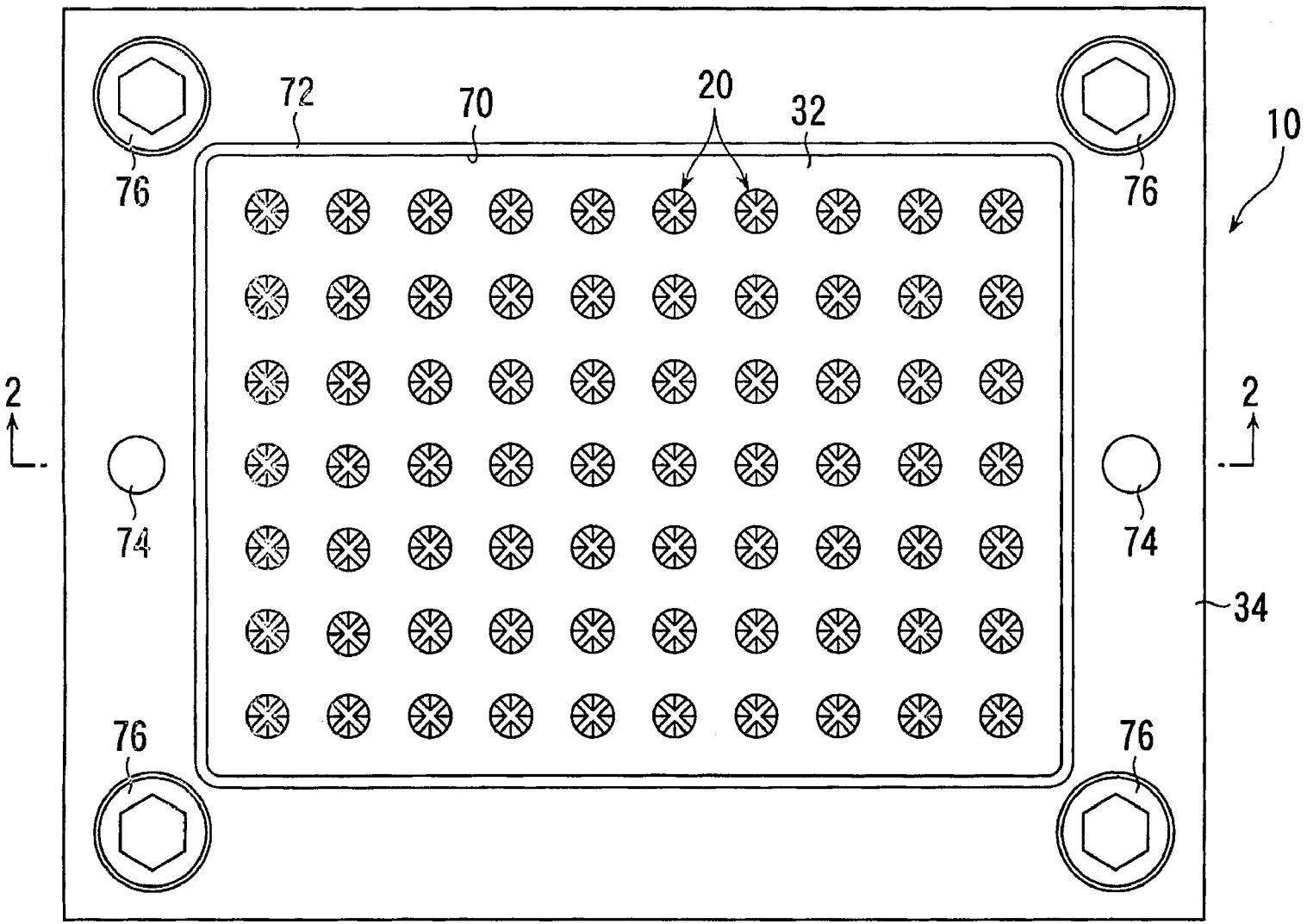
FIG. 1 is a plan view showing one embodiment of the electrical connecting apparatus according to the present invention, with the wiring base plate omitted.

Referring to FIGS. 1 through 9, the electrical connecting apparatus 10 is used to electrically connect a device under test 12 and testers in an electrical test as to whether a semiconductor device, particularly the plate-like device under test 12 such as an integrated circuit functions or not as per specification.

The device under test 12 has a plurality of projected electrodes 14 having a semispherical shape like a solder bump arranged in a matrix state on the plate-like base 16 having a rectangular shape. Each projected electrode 14 is electrically connected to the circuit within the base 16.

The electrical connecting apparatus 10 comprises a plurality of first pins 20, a plurality of second pins 22 corresponding to the first pins 20 in one-to-one relationship, a wiring base plate 24, an elastic body 26 laid on the wiring base plate 24, a lattice 28 disposed within the elastic body 26, a seat-like member 30 laid on the elastic body 26, a presser plate 32 laid on the seat-like member 30, and a rectangular frame 34 laid on the presser plate 32.

Figure 8:
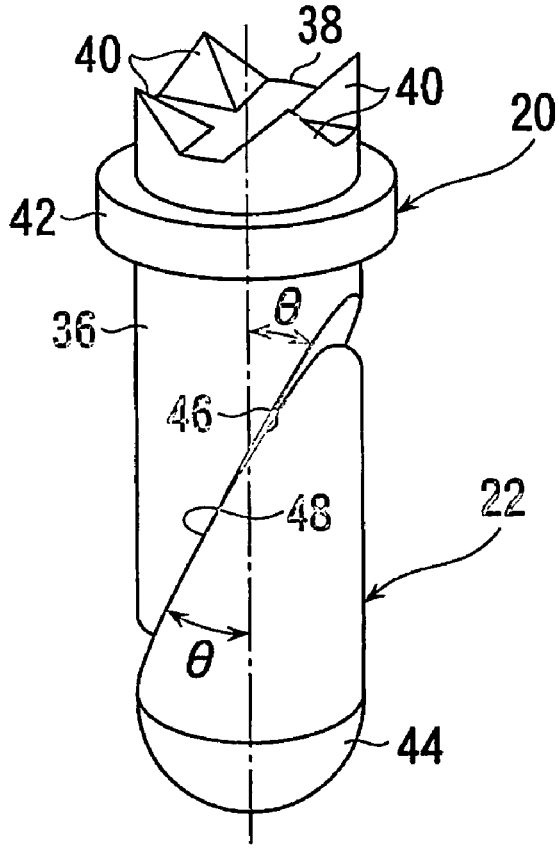
FIG. 8 is a perspective view of the pins showing one embodiment of the first and second pins used in the electrical connecting apparatus shown in FIG. 1.
Figure 9:
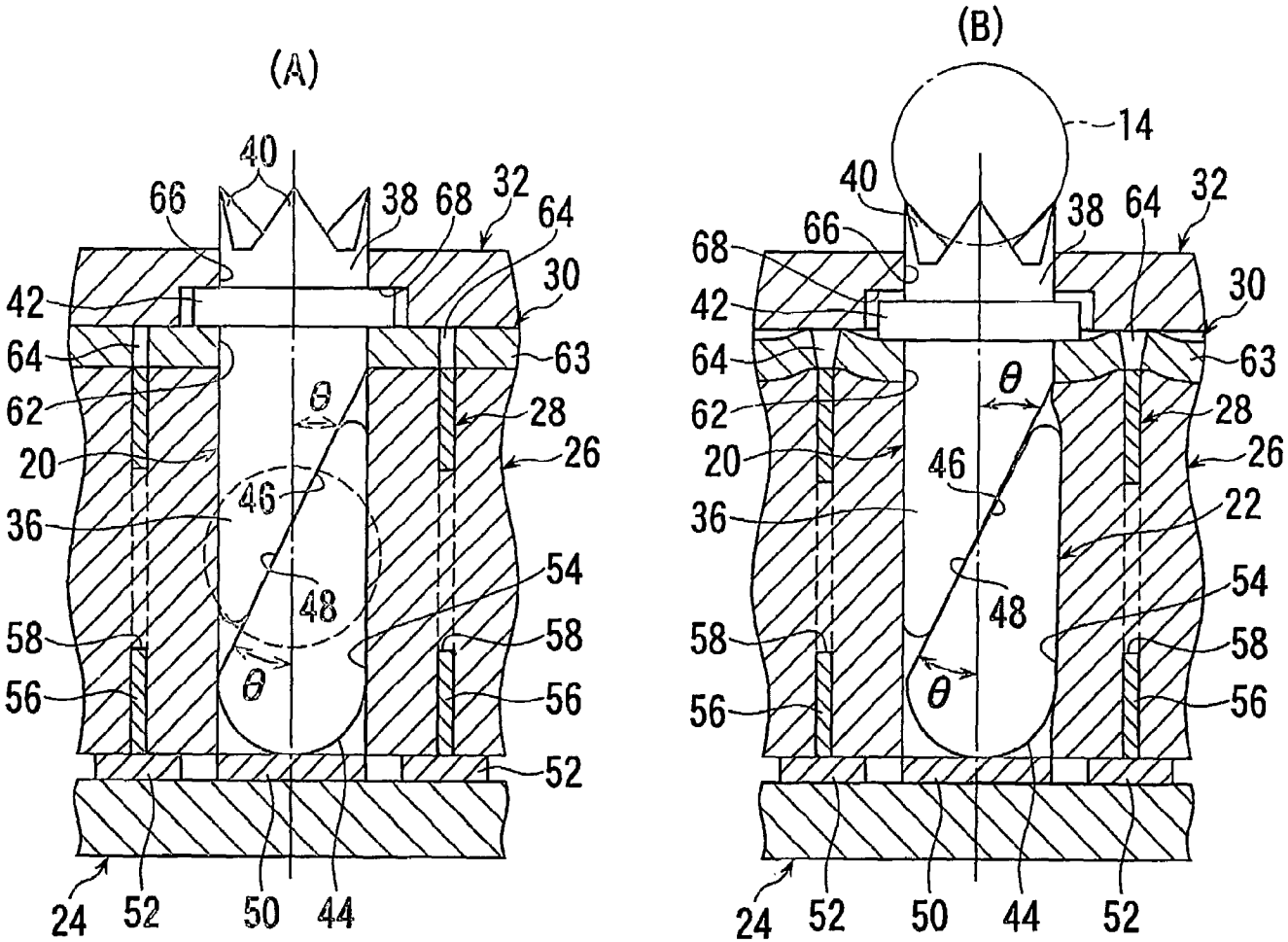

Each first pin 20 is provided, as shown in FIGS. 8 and 9, with a rod-like first portion 36, a second portion 38 integrally following the upper end of the first portion 36, a plurality of pyramidal projections 40 integrally formed at the upper end of the second portion 38, and a flange portion 42 integrally formed in the periphery of the lower end of the second portion 38.

The first and second portions 36 and 38 have the same diametral dimension. The plural projections 40 are spaced apart about the axis of the first pin 20 so as to act as contact portions to contact the projected electrodes 14 and make the top portions project toward the side opposite to the first portion 36.

Each of the second pins 22 has, as shown in FIGS. 8 and 9, substantially the same diametral dimension as the first and second portions 36 and 38 of the first pin 20 with its lower end portion formed as a spherical plane. The first and second pins 20 and 22 are disposed to adjoin in their axial direction with their axes coincided, and make the adjoining portions plane regions 46 and 48 capable of contacting each other.

The plane regions 46 and 48 are inclined at a predetermined angle θ relative to the axes of the first and second pins 20 and 22. The angle θ can be 60° or less, preferably 45° or less, and more preferably 30°.

Figure 2:
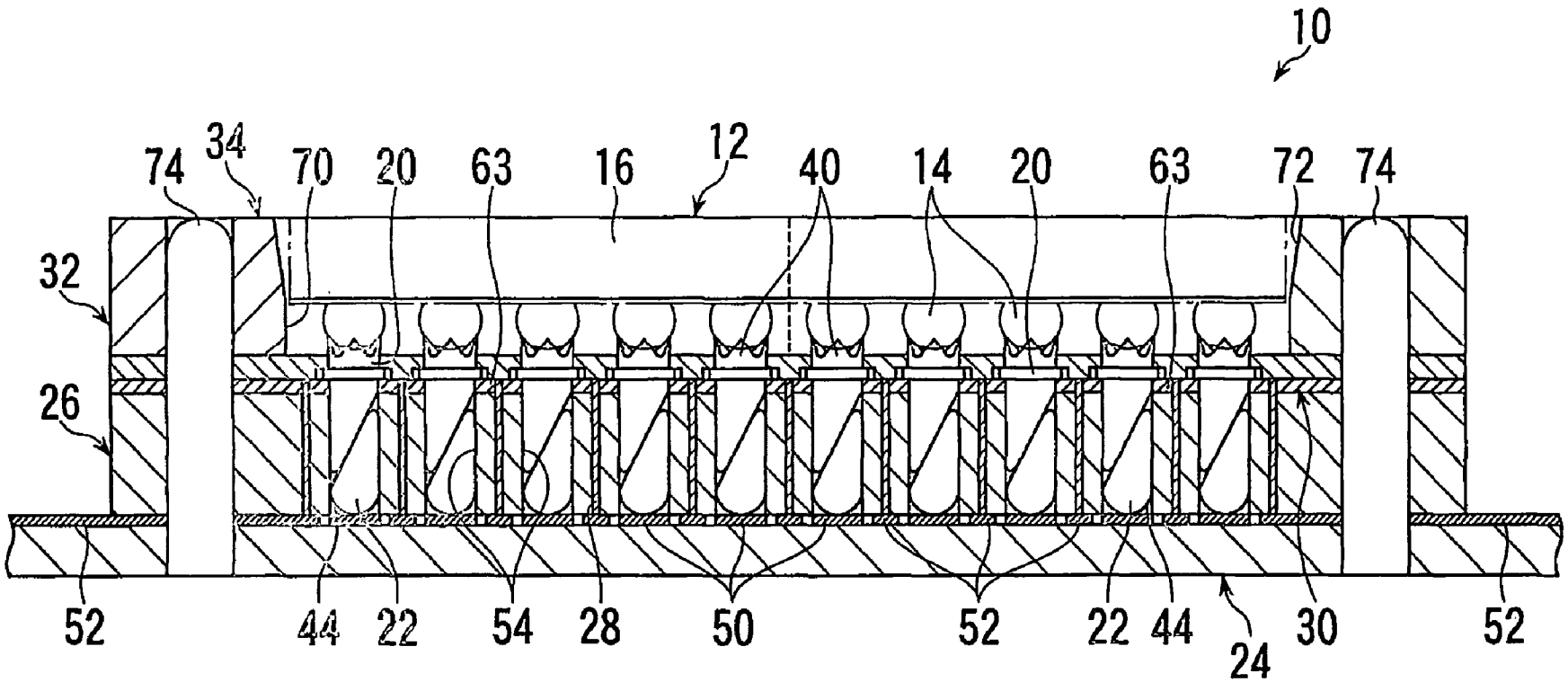
FIG. 2 is a section obtained along the line 2—2 in FIG. 1.

The wiring base plate 24 has, as shown in FIG. 2, a plurality of connection lands 50 individually corresponding to a pair of the first and second pins 20 and 22, and a plurality of lands 52 for grounding located between adjacent connection lands 50 on one face (the upper face) in the thickness direction. The connection lands 50 and grounding lands 52 are formed by a publicly known technique such as printed wiring technique.

The elastic body 26 is made of an electrically insulating rubber material such as silicone rubber so as to deform in three dimensionally by compression and has a plurality of through holes 54 individually corresponding to the pair of the first and second pins 20 and 22. The through holes 54 penetrate the elastic body 26 in its thickness direction. The first and second pins 20 and 22 are disposed in the through holes 54 so as to be vertically adjacent to each other with the spherical plane 44 of the second pin 22 brought into contact with the corresponding connection lands 50.

The lattice 28 is made of a conductive metal material. In the illustration, the lattice 28 has, as shown in FIGS. 2, 4, 5 and 6, a plurality of strip-like members 56 having substantially the same width dimension as the thickness dimension of the elastic body 26 and conductivity and combined vertically and laterally so as to partition an elastic region around each hole 54 of the elastic body 26 from adjoining elastic regions, making their width direction the thickness direction (vertical direction) of the elastic body 26.

Figure 6:
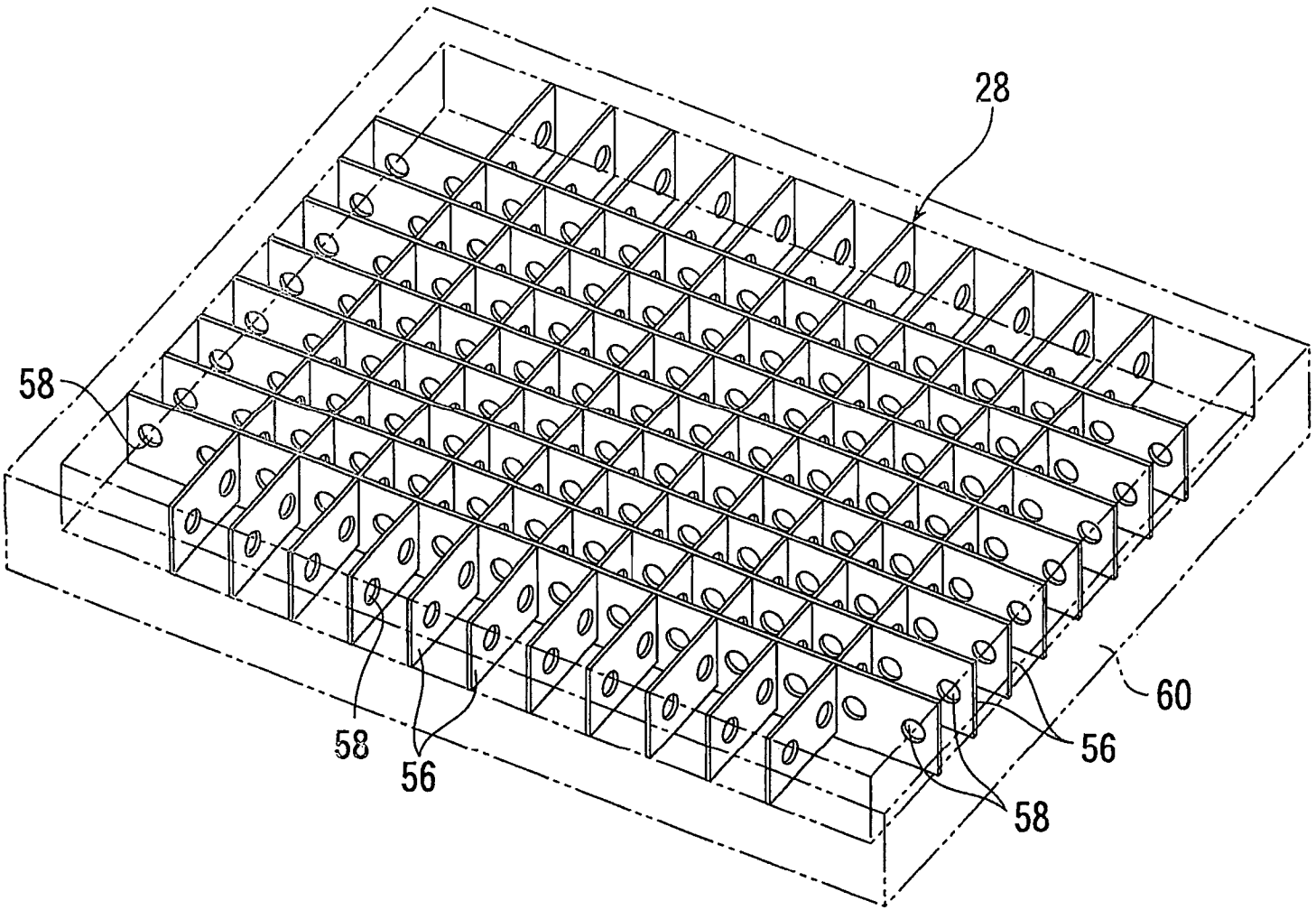
FIG. 6 is a perspective view for explaining one embodiment of the method of producing the elastic body and the lattice in the electrical connecting apparatus shown in FIG. 1.
Figure 7:
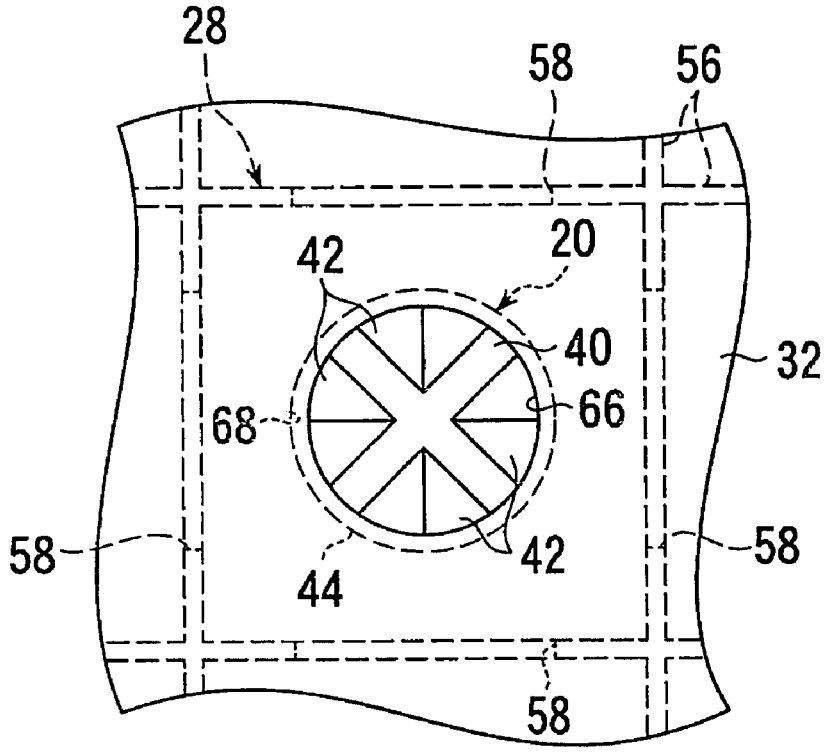
FIG. 7 is a plan view of the neighborhood of the first and second pins in the electrical connecting apparatus shown in FIG. 1.

Each strip-like member 56 has, as shown in FIG. 6, a plurality of holes 58 which make adjoining elastic regions partially continue. The lattice 28 may be, however, produced as one unit with the plural strip-like members 56 integrally combined vertically and laterally, and a hole 58 may not necessarily be formed in the strip-like member 56.

As shown in FIG. 6, the lattice 28 can be disposed inside the elastic body 26 with a plurality of strip-like members 56 vertically and laterally combined within a case-like form 60 opening upward, casting a rubber material into the form 60 up to a predetermined depth so that the strip-like members are not immersed, and hardening the rubber material.

The lattice 28 produced as above exposes both end faces in the width direction of each strip-like member 56 out of the elastic body 26. An integrated body of the elastic body 26 and the lattice 28 is laid on the upper face of the wiring base plate 24 such that the through hole 54 in the corresponding connection land 50 is opened, and that one end face in the width direction of each strip-like member 56 is brought into contact with at least one grounding land 52 (see FIG. 2).

Figure 3:
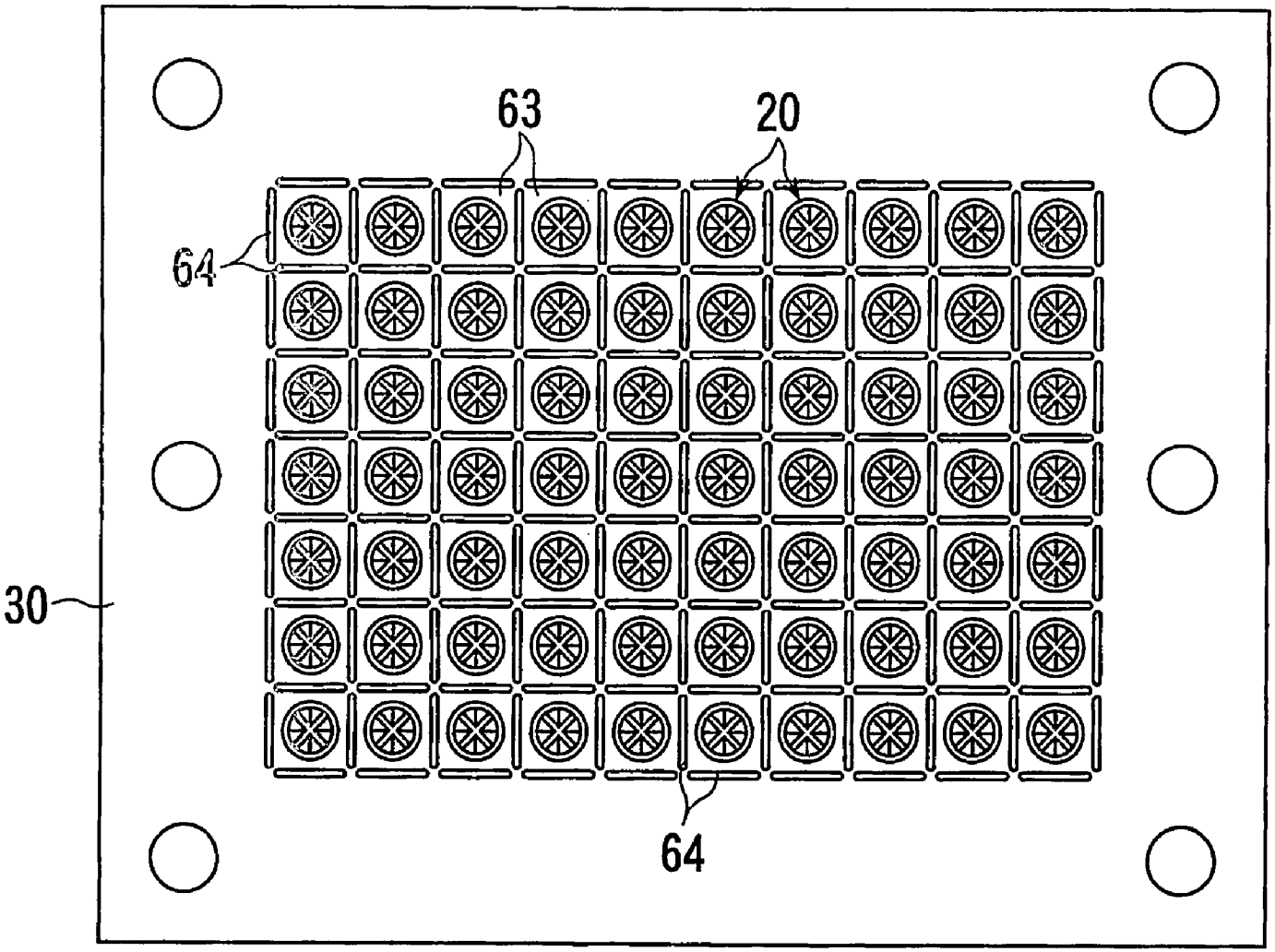
FIG. 3 is a plan view of the electrical connecting apparatus shown in FIG. 1, with the frame and the presser plate removed.
Figure 4:
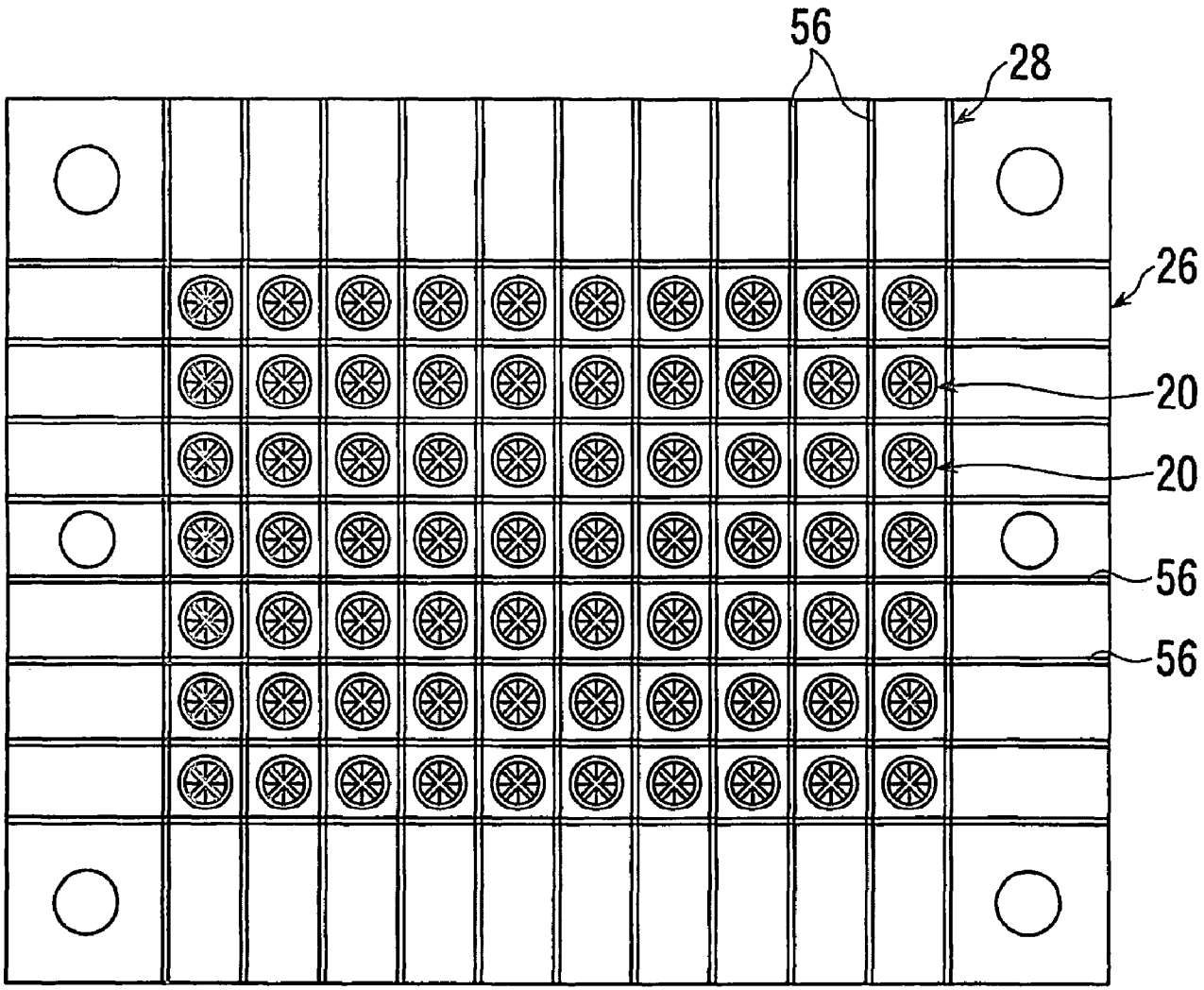
FIG. 4 is a plan view of the electrical connecting apparatus shown in FIG. 1, with the frame, the presser plate and the seat member removed.
Figure 5:
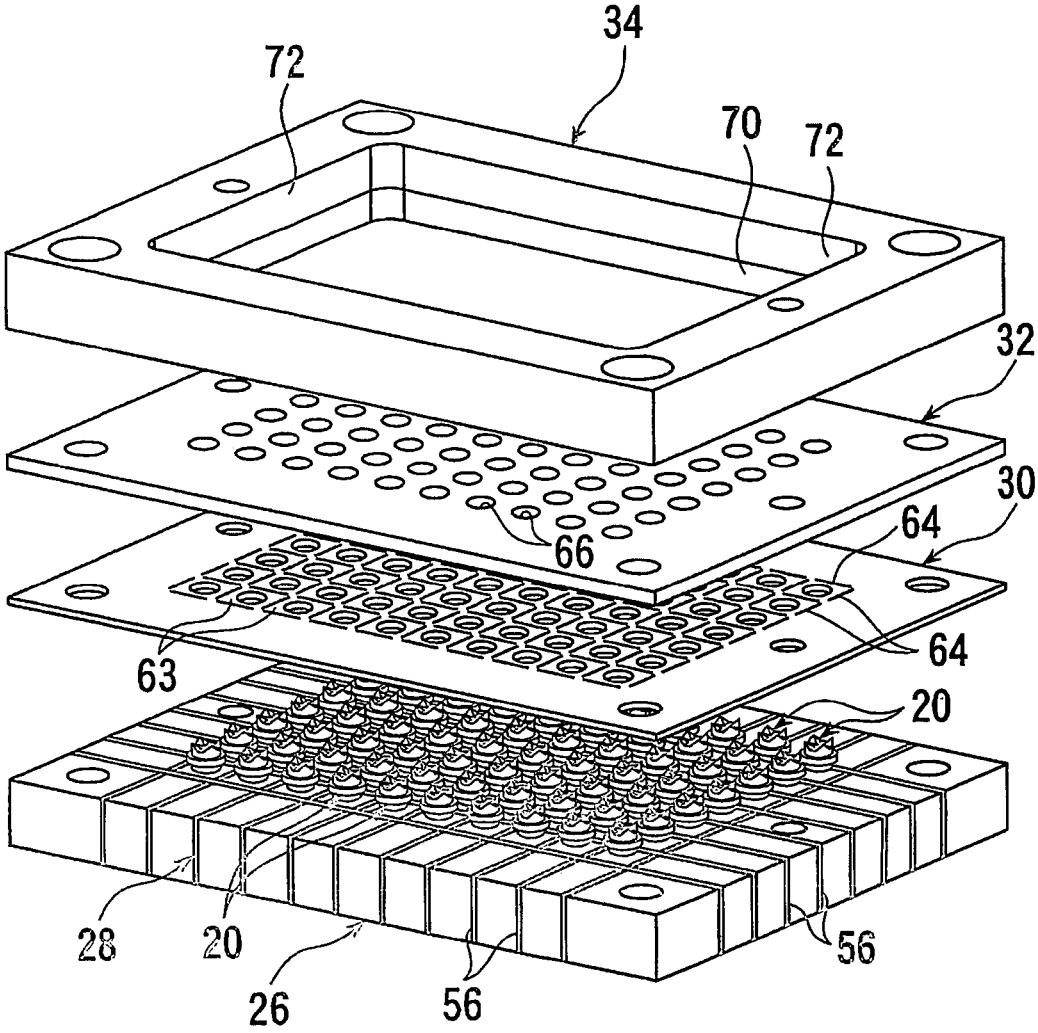
FIG. 5 is an exploded perspective view of members other than the wiring base plate of the electrical connecting apparatus shown in FIG. 1.

The seat-like member 30 is made of an electrically insulating resin or metal, preferably a resin such as polyimide. As shown in FIGS. 2 and 3, the seat-like member 30 has a plurality of through holes 62 penetrating the seat-like member 30 in its thickness direction, and a plurality of slits 64 for dividing seat-like regions 63 around the adjoining through holes 62 such that the seat-like regions 63 continue partially.

Each seat-like region 63 of the seat-like member 30 is broader than the flange portion of the first pin 20 and acts as a seat.

Each through hole 62, made to correspond to the through hole 54, opens in the corresponding through hole 54. Each seat-like region 63 corresponds to the elastic region of the elastic body 26 in one-to-one relationship. The seat-like member 30 is laid on the elastic body 26 and the lattice 28 such that each through hole 62 is opened in the corresponding through hole 54 and that each slit 64 opposes the strip-like member 56.

The presser plate 32 is, like the seat-like member 30, made of an electrically insulating resin or metal. The presser plate 32 has a plurality of holes 66 for individually receiving the second portion 38 of the first pin 20 such that its tip is projected, and a plurality of recesses 68 individually receiving the second portion 38 of the first pin 20 such that the tip portion of the first pin 20 is projected, and a plurality of recesses 68 individually receiving the flange portions 42 individually communicated to the holes 66.

Each hole 66 and each recess 68 are made coaxial and made to correspond to the through hole of the seat-like member 30 in one-to-one correspondence. The presser plate 32 is laid on the seat-like member 30 such that each hole 66 and each recess 68 are coaxial with the through hole 62.

The frame 34 is provided with a rectangular opening 70 having a dimension capable of receiving the base 16 of the device under test 12. Among the inner faces forming the opening 70, the upper part is made a diagonally upward inclined face 72 for guiding the device under test 12 correctly to the center side of the opening 70. The frame 34 is laid on the presser plate 32 so that all the first pins 20 may enter the opening 70 as viewed in plane.

The first portion 36 of the first pin 20 is inserted into the through hole 62 of the seat-like member 30 and the through hole 54 of the elastic body 26 such that the plane region 46 is downward, that the second portion 38 penetrates the hole 66 of the presser plate 32 to project upward, and that the flange portion 42 is received in the recess 68 of the presser plate 32.

The second pin 22 is inserted into the through hole 54 of the elastic body 26 such that the plane region 48 comes above to oppose the plane region 46 of the first pin 20. The diametral dimensions of first portion 36 of the first pin 20 and the second pin 22 can be substantially the same as the diametral dimensions of the through holes 54 and 62. As a result, both plane regions 46 and 48 are brought into contact in plane, and the spherical plane 44 of the second pin 22 is in contact with the connection land 50.

To arrange the first and second pins 20 and 22 as mentioned above, it is possible, for example, to lay the elastic body 26 on the wiring base plate 24, lay the seat-like member 30 on the elastic body 26 such that those overlapped members are positioned by passing a plurality of positioning pins 74, and then, pass the first portion 36 of the first pin 20 into the through holes 54 and 62, and thereafter, and then, pass the positioning pins 74, insert the second pin 22 into the through hole 54 into the presser plate 32 to lay the presser plate 32 on the seat-like member 30.

As a result, the first and second pins 20 and 22 are arranged in a laminated substance in which the seat-like member 30 and the presser plate 32 are laminated, so that they are prevented from falling out of the through holes 54 and 62.

The electrical connecting apparatus 10 is, thereafter, laid on the overlapped substance by passing the positioning pins 74 through the frame 34, and the wiring base plate 24, the elastic body 26, the seat-like member 30, the presser plate 32 and the frame 34 are combined by a plurality of screw members 76 so as to be capable of disassembling, thereby facilitating the assembling.

Where the positioning pins 74 are assembled into the wiring base plate 24, the positioning pins 74 are received in the holes of the elastic body 26, the wiring base plate 24 and the seat-like member 30 such that firstly the elastic member 26 overlaps the wiring base plate 24, and the seat-like member 30 is laid on the elastic body 26, and then, the first and second pins 20 and 22 are arranged as mentioned above, and thereafter, the positioning pins 74 are received into the holes of the presser plate 32 such that the presser plate 32 are laid on the seat-like member 30, thereby resulting in the overlapped substance.

Thereafter, the positioning pins 74 are received in the holes of the frame 34 so that the frame 34 and the overlapped substance may overlap, and finally, the laminated substance and the frame 34 are combined by a plurality of screw members 76.

The electrical connecting apparatus 10 is disposed in a testing apparatus such that the axial direction of the through holes 54 and 62 becomes the vertical direction. In that state, firstly the device under test 12 is disposed in the opening 70 of the electrical connecting apparatus 10 with the projected electrode 14 located downward. At this time, the first and second pins 20 and 22 are, as shown in FIG. 9A, maintained such that their axes extend vertically.

Next, the device under test 12 and the electrical connecting apparatus 10 are pressed in the direction to approach each other. By this, the projected electrode 14 and the pyramidal projection 40 are pressed, so that the projected electrode 14 and the first pin 20 are surely brought into electrical contact.

When the projected electrode 14 and the first pin 20 are pressed, the first pin 20 presses the second pin 22, thereby displacing the first and second pins 20 and 22 relatively. As a result, the elastic body 26 and seat-like member 30 are surely elastically deformed because the elastic region and the seat-like region 63 around the adjoining through holes 54 and 62 are respectively deformed independently.

Also, when the projected electrode 14 and the first pin 20 are pressed, since the plane regions 46 and 48 are inclined to the axis of the through hole 54, each first pin 20 is guided into the through hole 62 of the seat-like member 30, and the seat-like region 63 is separated by the slit 64, each first pin 20 is, as shown in FIG. 9B, surely displaced mainly in the axial direction of the through hole 54, and the seat region 63 is elastically deformed by the flange portion 44, thereby compressing and deforming the elastic region 63 of the elastic body 26 in the thickness direction.

On the other hand, the second pin 22, in which the plane regions 46, 48 are inclined to the axis of the through hole 54 and the spherical plane 44 is pressed against the connection land 50, is inclined, as shown in FIG. 9 (B), along the spherical plane 44, so that the elastic region of the elastic body 26 is compressed and deformed mainly in a direction to expand the through hole 54.

At the time of compression and deformation as mentioned above, since the force to compress the elastic body 26 in its thickness direction acts on the elastic body 26 through the seat-like member 30 and the elastic region of the elastic body 26 and the seat region 63 of the seat-like member 30 are independently deformed, the force is remarkably great in comparison with the case of directly deforming the elastic body 26 by the flange portion 42 and the case of expanding the through hole 54 by the first pin 20.

In the above-mentioned state, the device under test 12 is electrified. At this time, the connection land 50 is connected to a signal line of the tester, and the grounding land 52 is connected to the earth.

At the time of an electric test, since the first and second pins 20 and 22 are pressed in the plane regions 46 and 48 inclined to the axis of the through hole 54, a contact area of the first and second pins 20 and 22 becomes large, and the electrical contact resistance of the first and second pins 20 and 22 is small.

During the electric test, since each pair of the first and second pins 20 and 22 is shielded by the strip-like member 56 around the pins and electrically connected to the grounding land 52, a noise is restrained from mixing in the first and second pins 20 and 22.

When the device under test 12 is removed and the pressing of the first and second pins 20 and 22 are released, the first and second pins 20 and 22 are restored to the initial state by the elastic force of the elastic body 26.

At this time, the elastic body 26 and seat-like member 30, in which the elastic regions around the through holes 54 and 62 and the seat-like region 63 are respectively independently deformed, are surely restored to the initial state to surely restore the first and second pins 20 and 22 to the initial state.

Also, since the plane regions 46 and 48 are inclined to the axis of the through hole 54 and each first pin 20 was guided to the through hole 62 of the seat-like member 30, each first pin 20 is surely displaced mainly in the axial direction of the through hole 54.

Furthermore, the force to return the first pin 20 to the axial direction of through hole 54 surely acts on the flange portion through the seat-like member 30, and the frictional resistance between the first pin 20 and the elastic body 26 when the first pin returns to the axial direction of the through hole 54 is remarkably small in comparison with a conventional apparatus.

As mentioned above, according to the electrical connecting apparatus 10, the compressing force to compress and deform the elastic body 26 to the axial direction of the through hole 54 and the restoring force to return the first pin 20 to the axial direction of the through hole 54 become great in comparison with the conventional apparatus, so that the first and second pins 20 and 22 are surely restored to the initial states.

Figure 10:
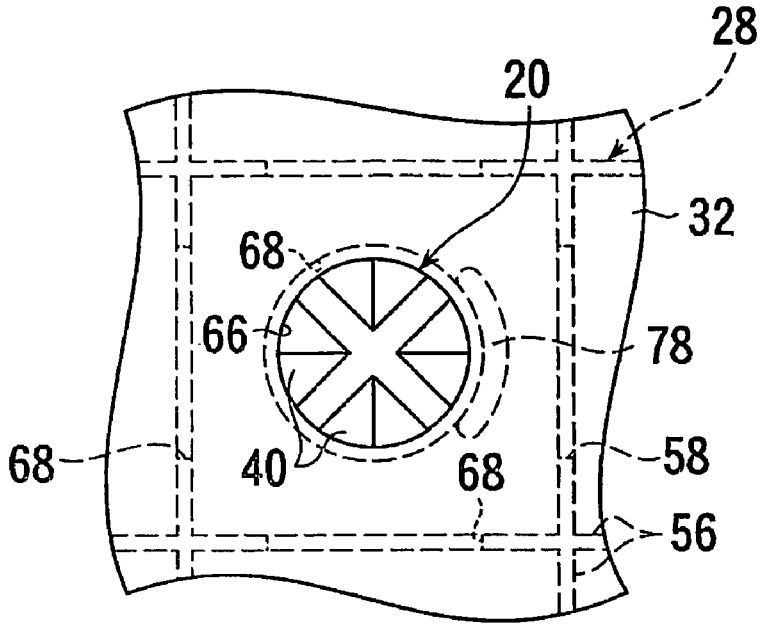
Figure 10:
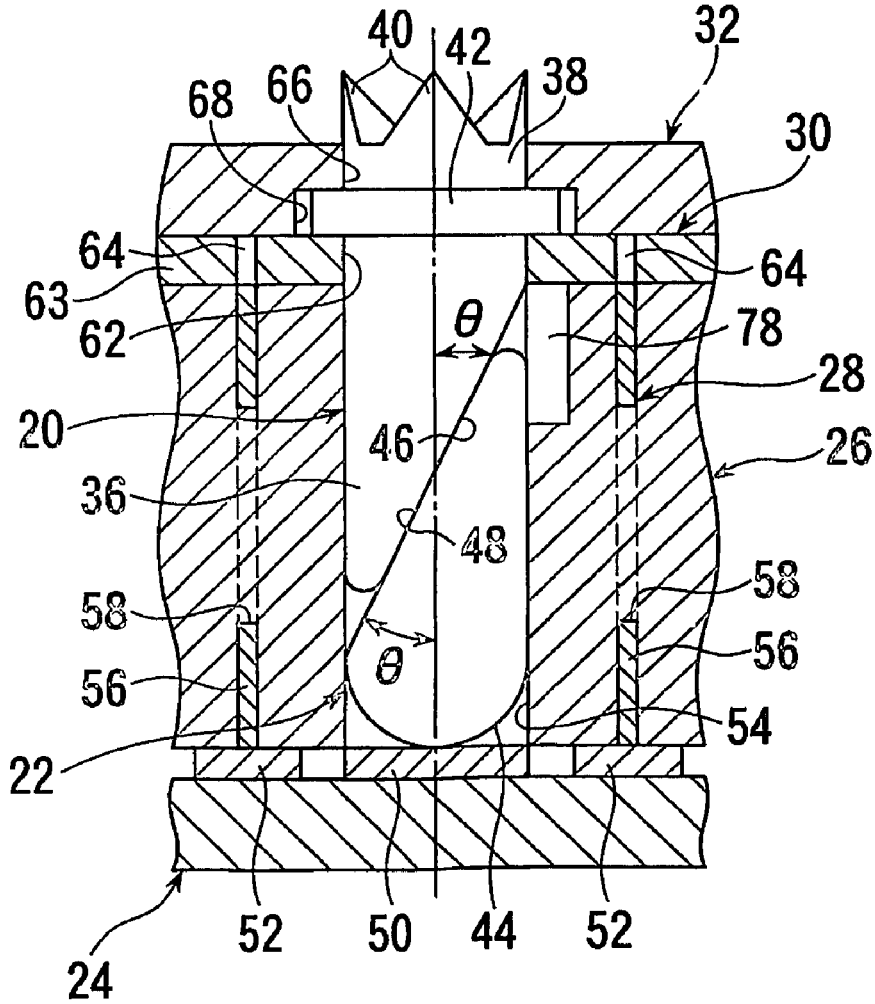

As shown in FIG. 10, the elastic body 26 may further have an arc-shaped recess 78 around the through hole and opening on the side of the shield member 30. If the recess 78 is formed in the elastic body 26, the second pin 22 is liable to incline to the axis of the through hole 54 when the first and second pins 20 and 22 are pressed relatively, so that it becomes easy for the first pin 20 to be displaced in the axial direction of the second pin 22.

Figure 11:
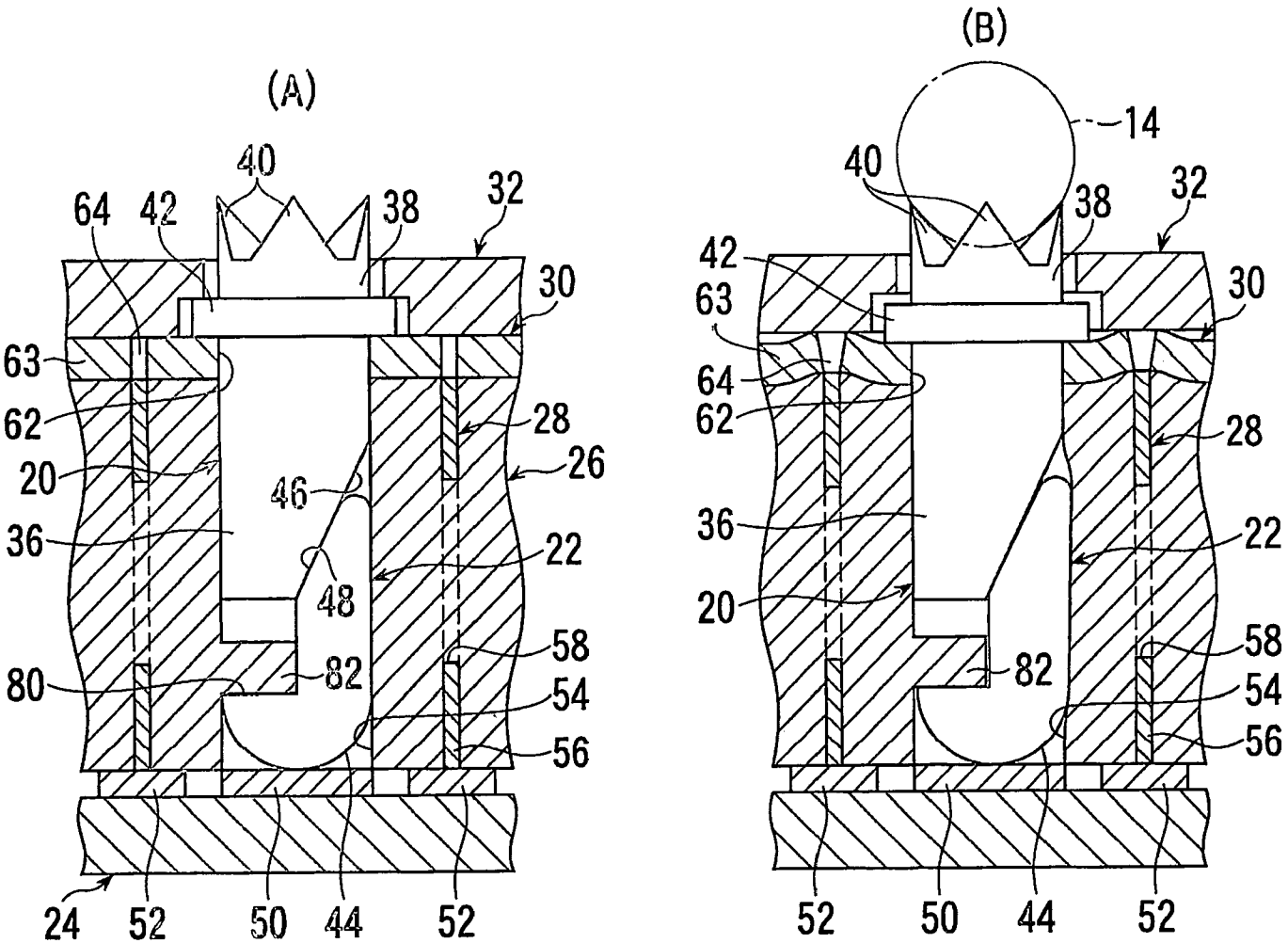

As shown in FIG. 11, it is possible to cut the second pin 22 in an L-letter shape at the lower part of its plane region 48, to form an upward stage portion 80 in the second pin 22, to form in the elastic body 26 a presser portion 82 projecting from the elastic body 26 into the through hole 54 to press the second pin 22 in the stage portion 80, and to form a space 84 acting as an escape portion of the first pin 20 above a presser portion 82 just in case the first and second pins 20 and 22 are relatively pressed.

As mentioned above, if the stage portion 80 and the presser portion 82 are respectively provided in the second pin 22 and the elastic body 26, the elastic region of the elastic body 26 is greatly compressed and deformed, and the second pin 22 is strongly pressed against the connection land 50.

As a result, it is possible to raise the contact pressure of the first and second pins 20 and 22 as well as the contact pressure of the second pin 22 and the connection land 50 by increasing the over drive amount and to reduce the electrical contact resistance of them at their contact portions.

It is possible to shape the plane regions 46 and 48 as follows. It is also possible to form a plane region in either one of the first and second pins and to form in the other of them a convex portion in contact with the plane region.

Figure 12:
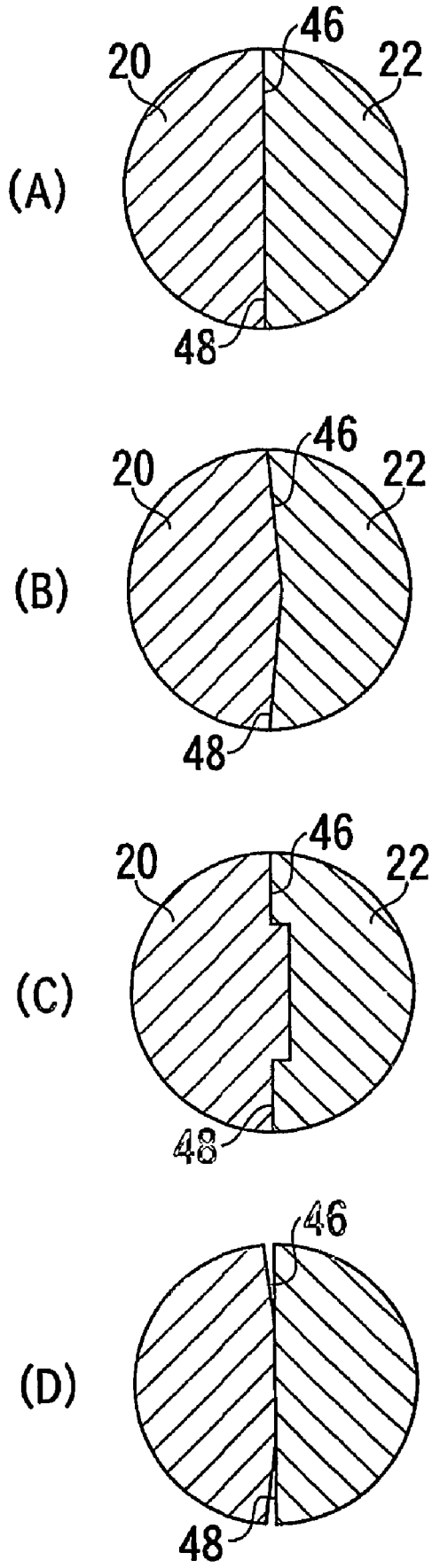
FIGS. 12A, 12B, 12C and 12D are cross sections respectively showing various embodiments of the plane regions of the first and second pins.

As shown in FIG. 12A, both plane regions 46 and 48 may be flat planes.

As shown in FIG. 12B, however, it is possible to make one plane region 46 a convex plane region having a cross-section somewhat bent at the center and the other a concave plane region having a cross-section bent likewise to be fitted on the convex plane region so as to be displaceable as mentioned above.

Also, as shown in FIG. 12C, it is possible to make one plane region 46 a convex plane region having a one-side open rectangular cross-sectional shape into which a convex plane region as mentioned above is fitted, and the other a concave plane region having a one-side open rectangular cross-sectional shape into which the convex plane region such as above is fitted so as to be relatively displaceable.

Furthermore, as shown in FIG. 12D, it is possible to make the one plane region 46 a convex plane region having an arcuate cross-sectional shape, and the other a flat plane region partially in contact with a convex plane region such as above.

If the plane regions 46 and 48 are made plane regions having such cross-sectional plane regions as shown in FIGS. 12B and 12C, the first and second pin 20 and 22 are prevented from relatively displacing in the cross-sectional direction.

In place of forming the seat region 63 acting as a seat by forming a slit 64 in the seat-like member 30, it is possible to use respective continuous integral seat regions as seats without forming any slit 64 in the seat-like member 30. It is also possible to make the seat regions as independent seats by completely separating them.

The present invention may be used in a state that the electrical connecting apparatus 10 comes either on the upper side or the lower side of the device under test 12, or may be used in a state that the electrical connecting apparatus 10 is slanted. Also, the present invention can be applied to another type of electrical connecting apparatus of a flat plate-like device under test such as a liquid crystal display panel.

The present invention is not limited to the foregoing embodiments but can be variously modified without departing from its spirit.

The invention claimed is:

1. An electrical connecting apparatus comprising:

a plate-like elastic body with a plurality of first through holes penetrating the elastic body in its thickness direction;

a plurality of elastically deformable seats having second through holes individually corresponding to said first through holes and arranged in the elastic body, the seats being laid on one face thereof in its thickness direction, each second through hole penetrating said seat in its thickness direction and being communicated to the corresponding first through holes;

a plurality of first pins, each provided with a first portion received in said first and second through holes, a second portion projected from said second through hole, and a flange portion which is capable of contacting with said seat; and a plurality of second pins received in said first through holes so as to adjoin in an axial direction of said first through holes relative to said first pins;

wherein said first and second pins are further provided with plane regions having an angle to the axial direction of said first through holes, said plane regions being in contact with each other.

2. An electrical connecting apparatus as claimed in claim 1, further comprising a wiring base plate provided with a plurality of connection lands individually corresponding to said first through holes, said wiring base plate being laid on the other face of said elastic body in its thickness direction, wherein each first through hole is opened individually in said connection land.

3. An electrical connecting apparatus as claimed in claim 2, wherein said second pin has the end portion on the side opposite to said first pin made a spherical plane and is brought into contact with said connection land at a part of said spherical plane.

4. An electrical connecting apparatus as claimed in claim 1, wherein either one of said plane regions of said first and second pins has a convex cross-sectional shape, and the other plane region has a concave cross-sectional shape into which said one plane region is fitted relatively displaceably.

5. An electrical connecting apparatus as claimed in claim 1, wherein said plurality of seats are integrally formed with a seat-like member having said second through holes and laid on said elastic body.

6. An electrical connecting apparatus as claimed in claim 5, wherein said seat-like member is further provided with a plurality of slits for dividing seat-like regions around adjoining second through holes so as to act as said seats so that the seat-like regions may partially continue.

7. An electrical connecting apparatus as claimed in claim 1, further comprising a lattice disposed inside said elastic body so as to partition into the elastic regions around adjoining first through holes.

8. An electrical connecting apparatus as claimed in claim 7, wherein said lattice includes a plurality of strip-like members partitioning into said elastic regions so that said elastic region may partially continue.

9. An electrical connecting apparatus as claimed in claim 1, further comprising a presser plate laid on said plural seats so as to sandwich said plural seats in cooperation with said elastic body, said presser plate including a plurality of holes which individually receive the second portions of the first pins to project their tip portions, and a plurality of recesses communicated to said holes and individually receiving said flange portions.

10. An electrically connecting apparatus as claimed in claim 1, wherein said first pin is further provided with at least one pyramidal projections projecting further from said second portion.

11. An electrically connecting apparatus as claimed in claim 1, wherein said elastic body is further provided with a recess around said first through hole and opening on the side of said seat.

12. An electrical connecting apparatus comprising:

a plate-like elastic body with a plurality of first through holes penetrating the elastic body in its thickness direction;

a plurality of elastically deformable seats having second through holes individually corresponding to said first through holes and arranged in the elastic body, each second through hole penetrating said seat in its thickness direction and being communicated to the corresponding first through holes;

a plurality of first pins, each provided with a first portion received in said first and second through holes, a second portion projected from said second through hole, and a flange portion which is capable of contacting with said seat; and a plurality of second pins received in said first through holes so as to adjoin in the axial direction of said first through holes relative to said first pins;

wherein at least one of said first and second pins is further provided on a side with a plane region having an angle to the axis of said first through hole, and wherein the other of said first and second pins is provided with a portion capable of contacting said plane region, said second pin being provided with said plane region and an L-shaped stage portion in the lower part of said plane region, wherein said elastic body is further provided with a presser portion projecting into said first through hole and pressing said second pin at said stage portion, said first pin and said stage portion forming, in said first through hole and above said presser portion, a space to serve as an escape for said first pin when said first and second pins are pressed relatively.

13. An electrically connecting apparatus as claimed in claim 1, wherein said second pin is provided with an L-shaped stage portion in the lower part of said plane region, and wherein said elastic body is further provided with a presser portion projecting into said first through hole and pressing said second pin at said stage portion, said first pin and said stage portion forming, in said first through hole and above said presser portion, a space to serve as an escape for said first pin when said first and second pins are pressed relatively.

* * * * *